US010517407B2

(12) United States Patent
Duwell et al.

(10) Patent No.: US 10,517,407 B2
(45) Date of Patent: Dec. 31, 2019

(54) ADJUSTABLE COMFORT MATTRESS SYSTEM AND PROCESSES

(71) Applicant: DREAMWELL, LTD, Las Vegas, NV (US)

(72) Inventors: Michael J. Duwell, Atlanta, GA (US); Michael S. DeFranks, Atlanta, GA (US)

(73) Assignee: DREAMWELL, LTD., Las Vegas, NV (US)

( * ) Notice: Subject to any disclaimer, the term of this patent is extended or adjusted under 35 U.S.C. 154(b) by 0 days.

(21) Appl. No.: 16/241,872

(22) Filed: Jan. 7, 2019

(65) Prior Publication Data

US 2019/0133333 A1 May 9, 2019

Related U.S. Application Data

(63) Continuation of application No. 15/146,165, filed on May 4, 2016, now Pat. No. 10,182,662.

(51) Int. Cl.

| | |
|---|---|
| ***A47C 27/08*** | (2006.01) |
| ***A47C 27/18*** | (2006.01) |
| ***A47C 27/05*** | (2006.01) |
| ***A47C 27/06*** | (2006.01) |
| ***A47C 27/10*** | (2006.01) |

(52) U.S. Cl.

CPC ..... *A47C 27/088* (2013.01); *A47C 27/053* (2013.01); *A47C 27/056* (2013.01); *A47C 27/064* (2013.01); *A47C 27/082* (2013.01); *A47C 27/083* (2013.01); *A47C 27/10* (2013.01); *A47C 27/18* (2013.01)

(58) Field of Classification Search

CPC ..... A47C 27/08
USPC ..... 5/710, 713, 720, 655.8
See application file for complete search history.

(56) References Cited

U.S. PATENT DOCUMENTS

| | | | |
|---|---|---|---|
| 685,160 | A | 10/1901 | Marshall |
| 4,234,983 | A | 11/1980 | Stumpf |
| 4,234,984 | A | 11/1980 | Stumpf |
| 4,439,977 | A | 4/1984 | Stumpf |
| 4,451,946 | A | 6/1984 | Stumpf |
| 4,523,344 | A | 6/1985 | Stumpf et al. |
| 4,578,834 | A | 4/1986 | Stumpf |
| 5,016,305 | A | 5/1991 | Suenens et al. |
| 5,113,539 | A | 5/1992 | Strell |
| 5,621,935 | A | 4/1997 | St. Clair |

(Continued)

*Primary Examiner* — Fredrick C Conley
(74) *Attorney, Agent, or Firm* — Cantor Colburn LLP

(57) ABSTRACT

Hybrid coil and air chamber assemblies for cushioning supports generally include pressurized air chambers that are positioned intermediate strings of pocketed coils. In this manner, the coils and air chambers can move independently but can be made to cooperate to provide firmness control, contouring and/or support of a user thereof. Air pressure within the air chambers can be independently adjusted to manipulate firmness and/or contour properties in specific zones defined by the presence and location of the air chambers, e.g., pressure of the air chambers corresponding to the lumbar region can be adjusted to eliminate high pressure points. Still further, the pressure within the air chambers can be automatically adjusted to different applied loads as a function of movement. Also disclose are processes for adjusting a mattress including the hybrid coil and air assemblies.

18 Claims, 9 Drawing Sheets

(56) References Cited

U.S. PATENT DOCUMENTS

| | | | | |
|---|---|---|---|---|
| 6,098,223 | A * | 8/2000 | Larson | A47C 27/088 5/716 |
| 6,143,122 | A | 11/2000 | Mossbeck et al. | |
| 6,256,820 | B1 | 7/2001 | Moser et al. | |
| 6,351,864 | B1 | 3/2002 | Karafa et al. | |
| 9,655,456 | B2 | 5/2017 | Boyd et al. | |
| 2005/0273939 | A1 * | 12/2005 | Mossbeck | A47C 23/047 5/720 |
| 2017/0311732 | A1 | 11/2017 | Boyd et al. | |

* cited by examiner

ADJUSTABLE COMFORT MATTRESS SYSTEM AND PROCESSES

BACKGROUND

The present disclosure generally relates to hybrid air chamber-coil spring mattress systems and processes, and more particularly, to an improved hybrid air chamber-coil spring mattress system having an interactive and adjustable pocketed coil and air chamber.

Varieties of mattress constructions are well known and are generally supplied in different degrees of firmness. For example, some mattresses are extremely soft and yieldable, i.e., plush, while others are relatively rigid and unyielding, i.e., firm. Once a mattress of a particular firmness has been purchased, it cannot generally be changed without the necessity of having to purchase another mattress. Individual preferences desired by one or two people sleeping on one mattress surface for comfort or to address pain or life changing events is often not fulfilled by current mattress designs.

The problem of supplying mattresses with various degrees of firmness is a considerable one. This applies to manufacturers and retailers who are typically required to maintain a large inventory of mattresses with different degrees of firmness. In addition, considerable difficulty arises with respect to hotels and the like which are often required to satisfy the particular requirements or tastes of its guests as to the firmness of the mattress in a particular room. For these reasons, it is desirable to provide a single mattress, which easily adjusts to provide different degrees of firmness.

A bedding or seating product can be fabricated from such strings of pocketed springs by binding or adhering the individual rows or strings of pocketed, i.e., wrapped, springs together to form a spring assembly which may be padded and encased in an upholstered covering. U.S. Pat. No. 6,143,122, which is fully incorporated by reference herein, discloses one such method of adhesively bonding strings of pocketed springs together to form a spring assembly.

A well-known type of bedding or seating product comprises a spring assembly which includes a number of discrete coil springs, each of which is enclosed in a fabric pocket in a length of folded fabric material. Longitudinal axes of the coil springs are generally parallel with one another so that the top and bottom end turns of the coil springs define top and bottom faces of the spring assembly. A row of such pocketed springs is known in the industry as a string (or strand) of pocketed springs. A bedding or seating product can be fabricated from such strings of pocketed springs by binding or adhering the individual rows or strings of pocketed springs together to form a spring assembly which may be padded and encased in an upholstered covering This type of spring assembly is commonly referred to as a pocketed spring assembly due to the fact that each spring is contained within an individual pocket of fabric material. The construction of strings of pocketed coil springs is well known in the art and, for example, is disclosed in U.S. Pat. No. 4,439,977, which is hereby incorporated by reference in its entirety. The system disclosed in that patent includes a spring coiler which forms a coil spring which is subsequently compressed and inserted between the plies of folded pocketing fabric material.

Pocketed spring assemblies are generally recognized to have a unique and particular luxurious feel to them and mattresses manufactured of such pocketed spring assemblies provide a feeling of softness without lacking spring resilience or support. Mattresses and similar articles constructed of pocketed spring assemblies are often considered a high-end type of product because of the added benefits and features of the pocketed coil springs. Mattresses and the like of this type can be more costly to manufacture and assemble as a result of the considerable amount of time and labor which is involved in their manufacture, together with the fact that the method of fabrication and assembly of such pocketed spring assemblies can be complicated, particularly in an automated process.

While pocketed spring assemblies are considered to provide a combination of softness and support, the ability to economically posturize a spring assembly or mattress of pocketed spring coils has heretofore been difficult. Posturization provides multiple zones or sections of differing firmnesses within a product such as a mattress. For example, the middle regions of the mattress, which typically support a person's torso, often require a firmer more resilient support while other areas of the mattress which support the feet and head of a person require a softer feel.

BRIEF SUMMARY

Disclosed herein are cushioning supports and processes for adjusting a firmness property of a mattress.

In one embodiment, a cushioning support includes a hybrid air-coil assembly. The hybrid air-coil assembly includes a pocketed spring assembly comprising a plurality of parallel strings of springs joined to each other, each of said strings of springs comprising a row of interconnected pockets, each of said pockets containing at least one spring encased in fabric; a plurality of oval shaped air chambers intermediate select portions of adjacent strings of springs; and an inflation control device in fluid communication with the plurality of oval shaped air chambers, wherein the inflation control device is configured to inflate or deflate selected ones of the plurality of oval shaped air chambers.

In another embodiment, a cushioning support includes a hybrid air-coil assembly including a pocketed spring assembly comprising a plurality of parallel strings of springs joined to each other, each of said strings of springs comprising a row of interconnected pockets, each of said pockets containing at least one spring encased in fabric; a plurality of T-shaped air chambers comprising a top air chamber in fluid communication with a bottom air chamber that collectively define a T-shape, the top air chamber having a horizontally oriented longitudinal axis and the bottom air chamber having a vertically oriented longitudinal axis, wherein portions of the top air chamber rests on top of the pocket spring assembly, and wherein the top air chambers are contiguously arranged to provide a planar surface; and an inflation control device in fluid communication with the plurality of T-shaped air chambers to selectively inflate or deflate selected ones of the plurality of T-shaped air chambers.

A process for adjusting a firmness property of a mattress includes providing a hybrid air-coil assembly comprising a pocketed spring assembly comprising a plurality of parallel strings of springs joined to each other, each of said strings of springs comprising a row of interconnected pockets, each of said pockets containing at least one spring encased in fabric; a plurality of T-shaped air chambers comprising a top air chamber in fluid communication with a bottom air chamber that collectively define a T-shape, the top air chamber having a horizontally oriented longitudinal axis and the bottom air chamber having a vertically oriented longitudinal axis, wherein portions of the top air chamber rests on top of the pocket spring assembly, and wherein the top air chambers are contiguously arranged to provide a planar surface; an inflation control device in fluid communication with the plurality of T-shaped air chambers to selectively inflate or deflate selected ones of the plurality of T-shaped air chambers, wherein the inflation control device is in operative communication with one or more sensors to selectively inflate and/or deflate one or more of the plurality of T-shaped air chambers upon detection of a triggering event; detecting the triggering event with the sensor; and inflating and/or deflating one or more of the plurality of T-shaped shaped air chambers.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

DETAILED DESCRIPTION

Disclosed herein are hybrid coil and air chamber assemblies for cushioning supports. Generally, hybrid coil and air chamber assemblies include pressurized air chambers that are at least positioned intermediate strings of pocketed coils. In this manner, the coils and air chambers can move independently but can be made to cooperate to provide firmness control, contouring and/or support of a user thereof. Advantageously, the hybrid coil and air chamber assemblies provide improved air flow about the pocketed coils and air chambers. Moreover, air pressure within the air chambers can be independently adjusted to manipulate firmness and/or contour properties in specific zones defined by the presence and location of the air chambers, e.g., pressure of the air chambers corresponding to the lumbar region can be adjusted to eliminate high pressure points. Still further, the pressure within the air chambers and be automatically adjusted to different applied loads on the cushioning support as a result from different positions and body types.

Figure 1:
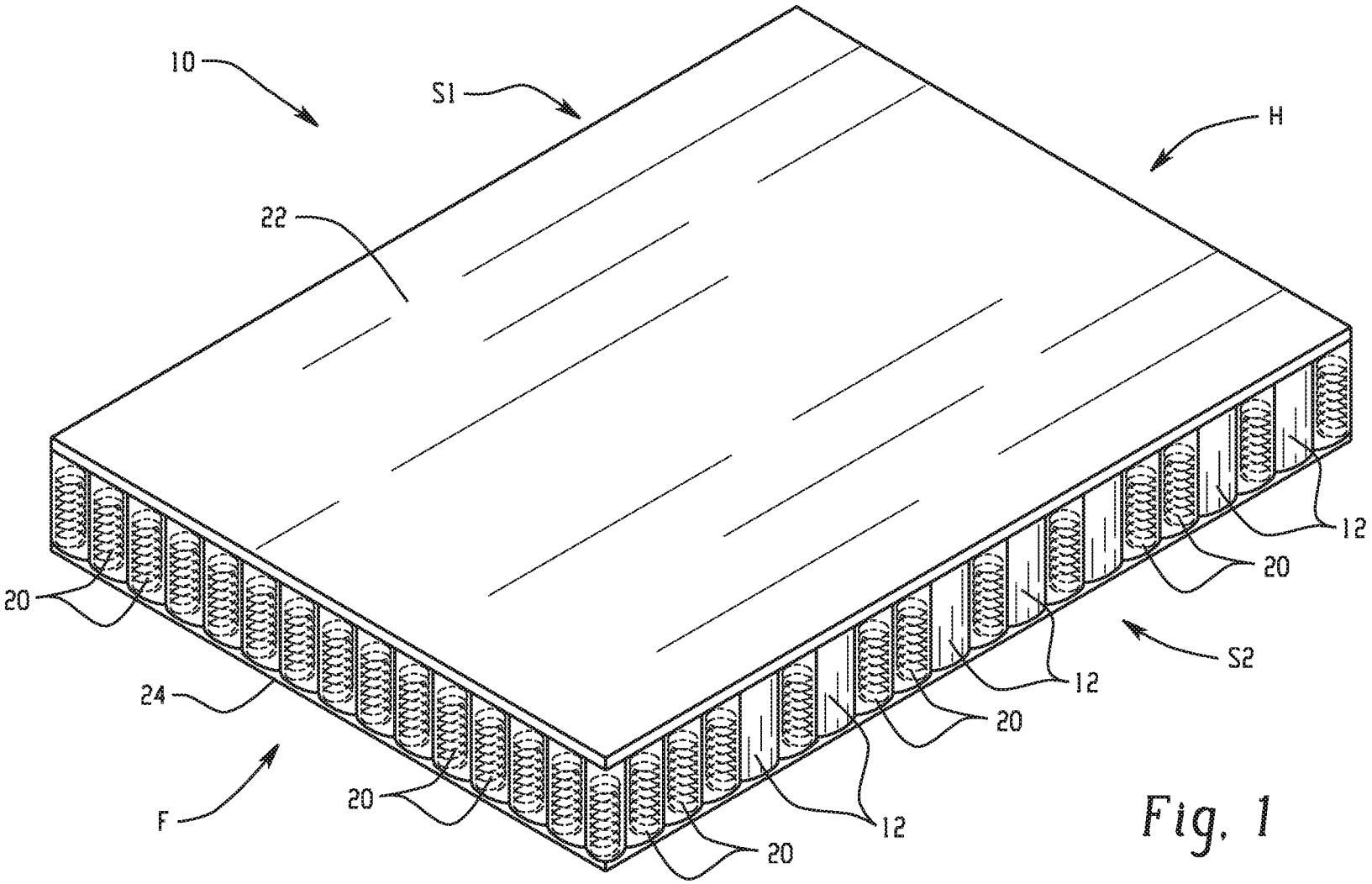
FIG. 1 ("FIG.") is a perspective view of a hybrid air-coil spring assembly in accordance an embodiment of the present disclosure.

Turning now to FIG. 1, there is depicted a perspective view of a hybrid air-coil spring assembly in accordance with an embodiment of the present disclosure, generally designated by reference numeral 10. In certain embodiments, the hybrid air-coil spring assembly 10 is adapted for a cushioned support structure such as a mattress. In these embodiments, the hybrid air-coil spring assembly 10 is generally rectangularly shaped and includes a head end (H), a foot end (F) and sides (S1, S2). The mattress may be a standard mattress size such as twin, twin XL, full, full XL, queen, Olympic queen, king, or California king or split king. It may also be a custom size. In addition, the cushioned support structure could be a smaller mattress designed for a child or baby. Such a mattress may be part of a crib or cradle.

Although a mattress is illustrated and generally discussed herein, the present disclosure may be used to construct any bedding or seating product desiring a cushioning support. Likewise, although reference is made herein to rectangular shaped supports, it should be apparent that other geometric forms are contemplated.

The illustrated hybrid air-coil spring assembly 10 generally includes a plurality of inflatable oval-shaped air chambers 12 and a plurality of strings of pocketed coil springs 20, which are sandwiched between layers 22 and 24. The layers can be foam, fiber or the like. The oval-shaped air chambers 12 are selectively situated between strings of pocketed coils and extend from side (S1) to side (S2). As such, the longitudinal axis for the oval-shaped air chambers 12 is vertically oriented with respect to ground. In other embodiments, the oval-shaped air chambers are discontinuous and extend a fraction from one side of the cushioning support to the other side, which may be desired when the intended application a mattress and is configured for two occupants of dissimilar sizes, weights, sleep positions, and/or the like. Still further, instead of side to side, the oval shaped air chambers extend from the head end (H) to the foot end (F). In other embodiments, the air chambers may be discontinuous and extend a fraction from head to foot or side to side with multiple extension to provide cushioning supports for specific zones. Optionally, a low friction material (or coating on the air chamber) can be used intermediate the pocketed coils and air chambers to reduce wear during use. For example, an open weave material may be used and may also be disposed between the interior surfaces of a side rail, if present, that may be in direct contact with the air chambers and pocketed coils or the one or more foam layers above the layer of air chambers and coils.

The oval-shaped air chambers 12 are formed of a resilient film like material, e.g., a flexible plastic or rubber such as polyurethane, polyester, vulcanized rubber or the like. In one embodiment, the height of the oval-shaped air chambers 12 ranges from 1 to 10 inches; and 2 to 6 inches in other embodiments. The width of the oval shaped chambers can vary depending on the degree of interaction desired with the pocketed coils. In most embodiments, the width will be in a range of 2 to 6 inches, although higher or lower widths are contemplated.

Figure 2:
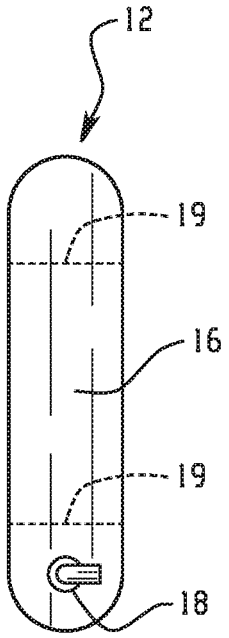
FIG. 2 is an end on view of an oval shaped air chamber for use in a hybrid air-coil spring assembly in accordance with the present disclosure.
Figure 3:
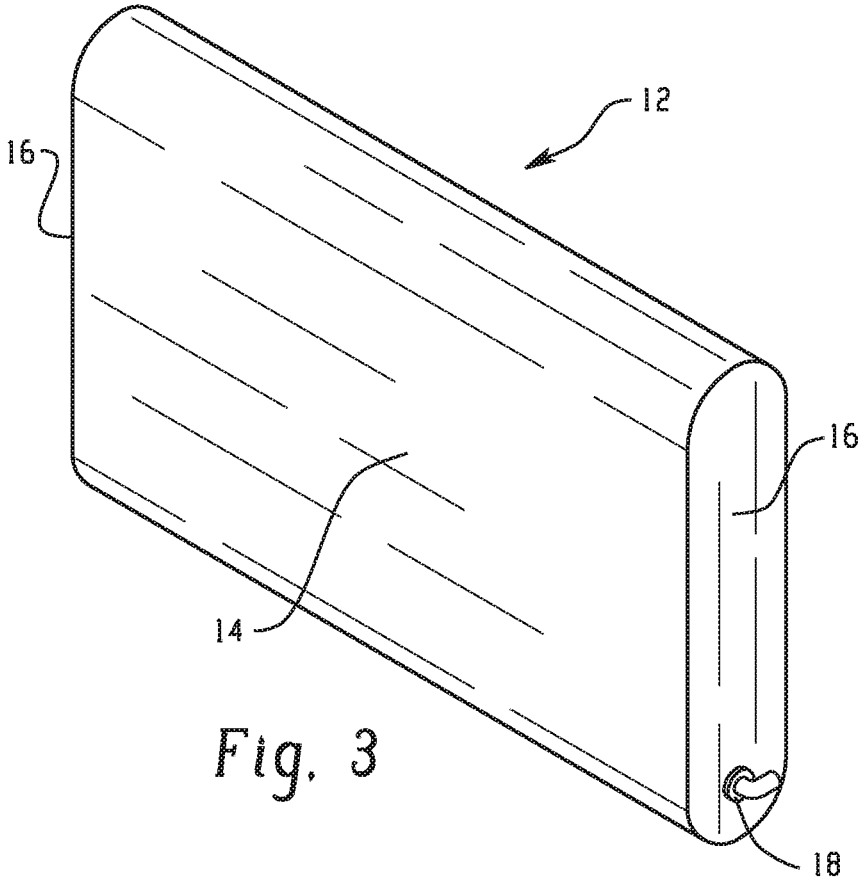
FIG. 3 is a perspective view of the oval shaped air chamber of FIG. 2 in accordance with the present disclosure.

Referring now to FIGS. 2 and 3, each of the oval-shaped air chambers 12 generally includes a body portion 14 and ends 16, wherein the body portion generally has a sleeve shape and is sealed at each opening by the ends 16. A selected one of the ends includes a valve 18 (or fitting). The location of the valve is not intended to be limited and may further include a sensor, e.g., a pressure sensor, a noise sensor or the like, in some applications that generally function to open and close the valve or provide quick disconnect features for conduit. In the embodiment shown, the valve 18 is positioned at a lower portion of the selected end 16 and is in fluid communication with a conduit (not shown), which may be fluidly coupled via a manifold (not shown) to an inflation control device, e.g., air pump (not shown), for selectively and independently regulating air pressure within each of the oval-shaped air chambers as will be described in greater detail below. Additionally, the oval-shaped air chambers may include internal baffles 19, two of which are shown that function to partition and regulate flow of air within the air chamber and to control the expansion rate of the air chamber(s).

Figure 4:
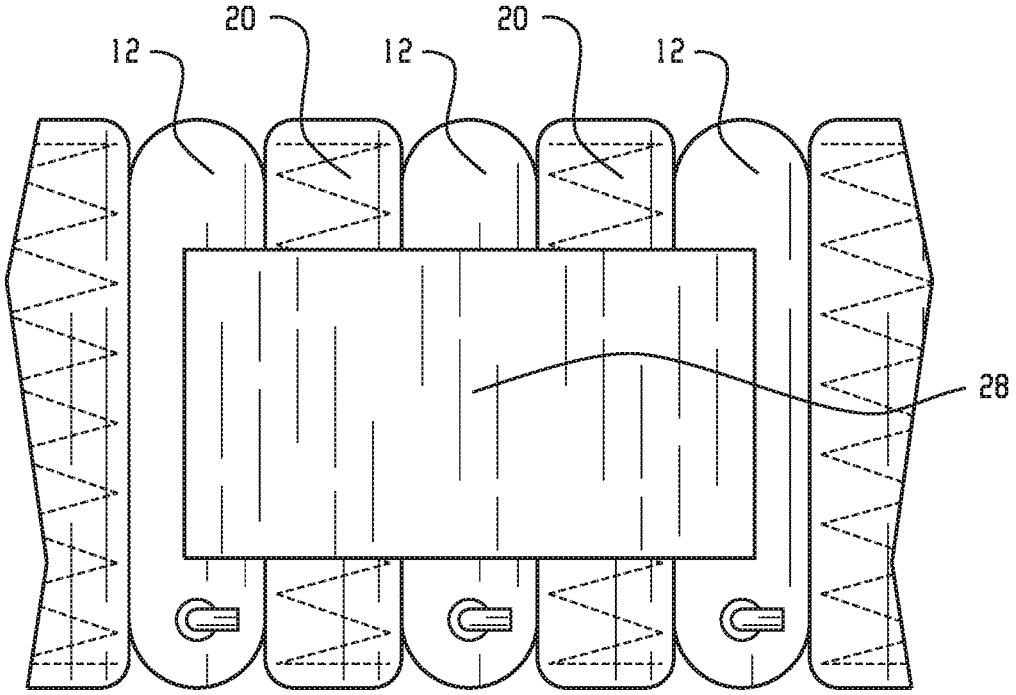
FIG. 4 is a partial side elevational view of a hybrid air-coil spring assembly depicting a plurality of oval shaped air chambers and pocket coils in accordance with the present disclosure.

Referring back to FIG. 1 and to FIG. 4, the pocketed coils 20, also known as wrapped coils, encased coils, or Marshall coils, are in the form of strings and extend from side (S1) to side (S2) or, in other embodiments, can extend from head to foot end. The construction of the pocketed coils is in the form of strings with the coils aligned in columns so that the coils line up in both longitudinal and lateral directions or they may be nested in a honeycomb configuration, wherein coils in one row are offset from coils in an adjacent row as is generally known in the art. Adjacent strings of spring coils may be connected with adhesive or other fastening means. The coil springs are not intended to be limited to any specific coil type. As is generally known in the art, the coils can be of any diameter; be symmetrical or asymmetrical, be designed with linear and/or non-linear behavior, or the like as may be desired for different intended applications. In one embodiment, the height of the coil springs range from 1 to 10 inches; and 2 to 6 inches in other embodiments. The coils 20 and the oval-shaped air chambers 12 have substantially the same height. In other embodiments, the vertical oriented air chambers 12 are about 0.5" to about 1.0" higher than the pocketed coils and can vary in height in relationship to coils to achieve different lift rates during use. This provides the lift characteristics as the pressure in the chamber increases, thus higher firmness.

By way of example, the coil spring may be may be helical or non-helical spring, nested coils, multi-strand coils, or the like. Examples of such construction are disclosed in U.S. Pat. Nos. 685,160, 4,234,983, 4,234,984, 4,439,977, 4,451,946, 4,523,344, 4,578,834, 5,016,305 and 5,621,935, the disclosures of which are incorporated herein by reference in their entireties.

Optionally, a flexible side skirt 28 may be attached via an adhesive, weld, fasteners, sewing or the like to the ends 16 of the oval-shaped air chambers 12 as shown in FIG. 4. The side skirt 28 may be formed of the same material or a different material as the oval-shaped chambers and are fixedly attached to the various ends 16 of the oval-shaped chambers.

One or more foam and/or non-foam (microcoils, evenloft, etc.) layers 22 of preselected thickness may cover the hybrid air-coil spring assembly 10 and provide a generally planar surface on which one or more persons can sleep. This planar surface composition may be permanently attached or removable by means of a zipper or other types or releasable closure devices. Having a removable surface cover allows for different covers to be applied after purchase by a consumer and provides access to the innercore unit in the event service is required. Likewise, one or more foam layers 22 may be disposed underneath the innercore assembly 10. Preferably, the hybrid air-coil spring assembly 10 is covered on both sides with the foam layers and has a fabric cover, thereby defining, for example, a unitary mattress assembly. Likewise, the cushioning support structure including the hybrid air-coil assembly 10 may include a sidewall assembly (not shown) about the perimeter, which may be formed of foam, coils, and combinations thereof as is generally known in the art.

Figure 5:
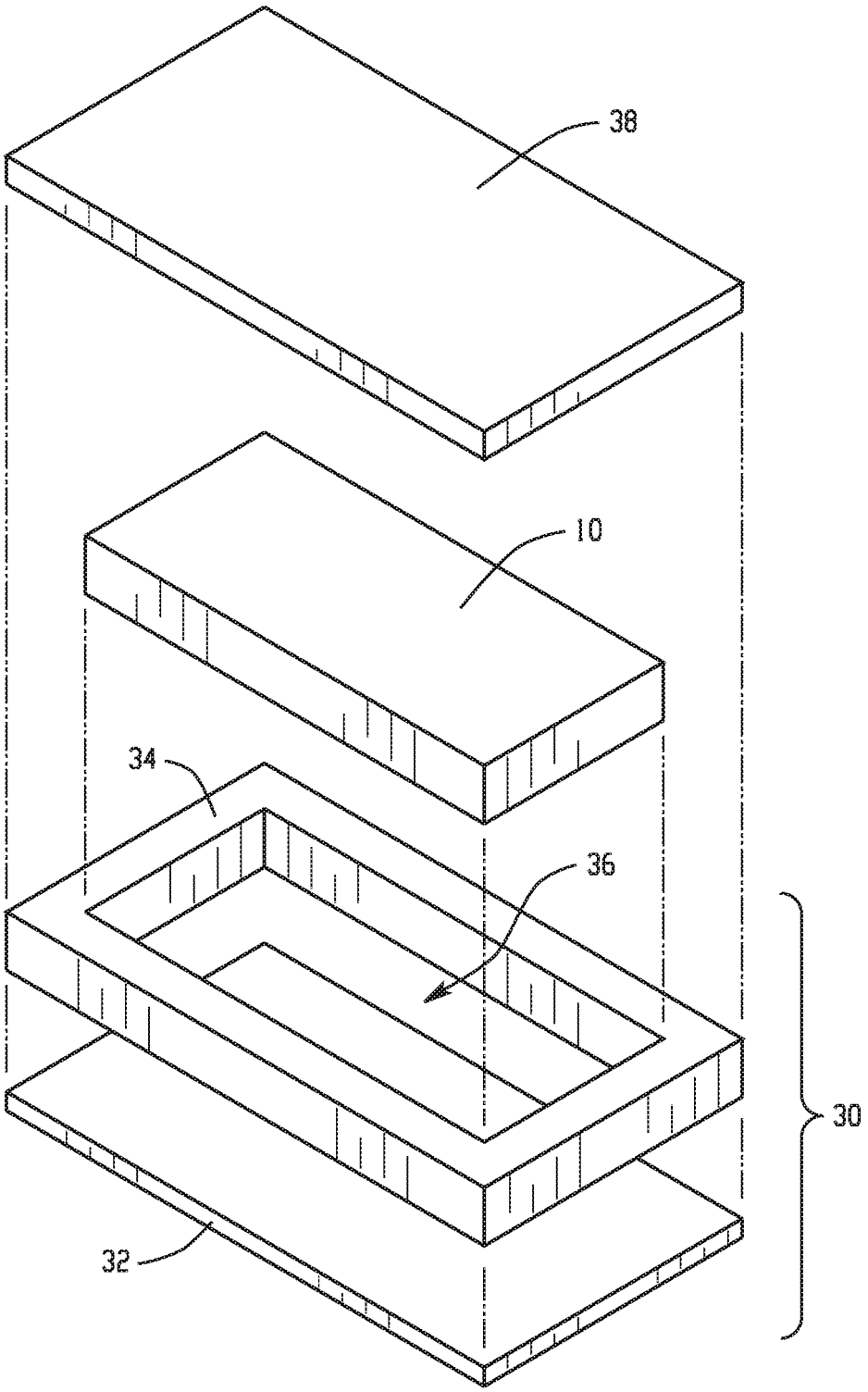
FIG. 5 is an exploded perspective view of a bucket assembly including hybrid air-coil spring assembly in accordance with the present disclosure.

In other embodiments, the hybrid air-coil spring assembly 10 functions as an innercore unit and is disposed within a bucket assembly. An exemplary bucket assembly 30 is shown in FIG. 5 and generally includes a planar base layer 32 dimensioned to approximate the length and width dimensions of the intended mattress. The base layer 32 may consist of foam, fiber pad or it may comprise a wooden, cardboard, or plastic structure selected to provide support to the various components that define the mattress, e.g., innercore unit, side, end rails, and the like. Depending on the properties of hybrid air-coil assembly, e.g., hybrid air-coil spring assembly 10 as shown in FIG. 1, stiffer or more compliant base layers may be chosen. By way of example, the base layer 32 may be formed of a high density polyurethane foam layer (20-170 pounds-force, also referred to as the indention load deflection (ILD)), or several foam layers (20-170 pounds-force ILD each), that alone or in combination, provide a density and rigidity suitable for the intended mattress manufacture. Other foams or fiber pads may be used. Such a choice is well within the skill of an ordinary practitioner.

A side rail assembly 34, which can be manufactured as a single piece or as multiple pieces, is affixed about the perimeter of the planar base layer 32 to define the bucket. The side rail assembly 34 can be constructed from a dense natural and/or synthetic foam material of the type commonly used in the bedding arts. The rails can be a lamination of different types of foams to accommodate different applications for support, chase or channel for conduit, encasement, and/or cushioning.

For mattress applications, the size of the side rail assembly 34 can vary according to the mattress size and application, but each rail typically measures 3-10 inches (7.5-25 cm) in thickness. The depicted side rails are typically equal in width, and their length is chosen to correspond to the length of the size of mattress desired. For a regular king size or queen size mattress, the length of rails can be about 78.5 inches (200 cm), although the length can vary to accommodate the width of the header or footer, if the header or footer is to extend across the full width of the base platform 102. Similarly, the header/footer piece typically has a thickness of about 3-10 inches (7.7-25 cm), and the width is chosen to correspond to the width of the size of mattress desired. In the case of a regular king size mattress the width would be about 75.25 inches (191 cm), and for a queen size mattress, the width would be about 59.25 inches (151 cm), depending on how the foam rails are arranged to form the perimeter sidewall.

The side rail assembly 34 can be mounted or attached to base layer 32 by conventional means, such as (but not limited to) gluing, stapling, heat fusion or welding, or stitching.

The bucket assembly 30 formed of the base layer 32 and side rail assembly 34 as constructed defines a well or cavity 36. The well or cavity 36 provides a space in which the hybrid air-coil assembly 10 can be inserted as shown. An additional layer 38 may be disposed over the innercore unit and bucket assembly 30.

The various foam layers discussed above may be the same or different. Exemplary foams include, but are not limited to, polyurethane foams, latex foams including natural, blended and synthetic latex foams; polystyrene foams, polyethylene foams, polypropylene foam, polyether-polyurethane foams, and the like. Likewise, the foam can be selected to be viscoelastic or non-viscoelastic. Any of these foams may be open celled or closed cell or a hybrid structure of open cell and closed cell. Likewise, the foams can be reticulated, partially reticulated or non-reticulated foams. The term reticulation generally refers to removal of cell membranes to create an open cell structure that is open to air and moisture flow. Still further, the foams may be gel-infused in some embodiments and/or may include a phase change material. The different layers can be formed of the same material configured with different properties or different materials.

The hybrid air-coil spring assembly 10 including the plurality of inflatable oval-shaped air chambers 12 and a plurality of strings of pocketed coil springs 20 as discussed above can provide a cushioning support such as a mattress with numerous configurations. For example, the oval-shaped air chambers can be positioned in a mattress application to provide support in the lumbar, shoulder-neck, and/or upper calf regions. Each air chamber 12 is independently connected to a conduit to provide air delivery for inflation and deflation specific to the particular air chamber. Hose connections between chambers will be oriented towards the sides, which may be desirable for mattress applications so as to minimize any artifact feel to the user. Placement of plumbing and configurations will change or vary by mattress type, size and whether single or dual sided. These fittings and connections can be located near the bottom of the chamber as noted above and can provide clearance for lowering due to deflation and inflation. Likewise, it should be apparent that quick disconnect fittings can be employed as may be desired for some applications.

Figure 6:
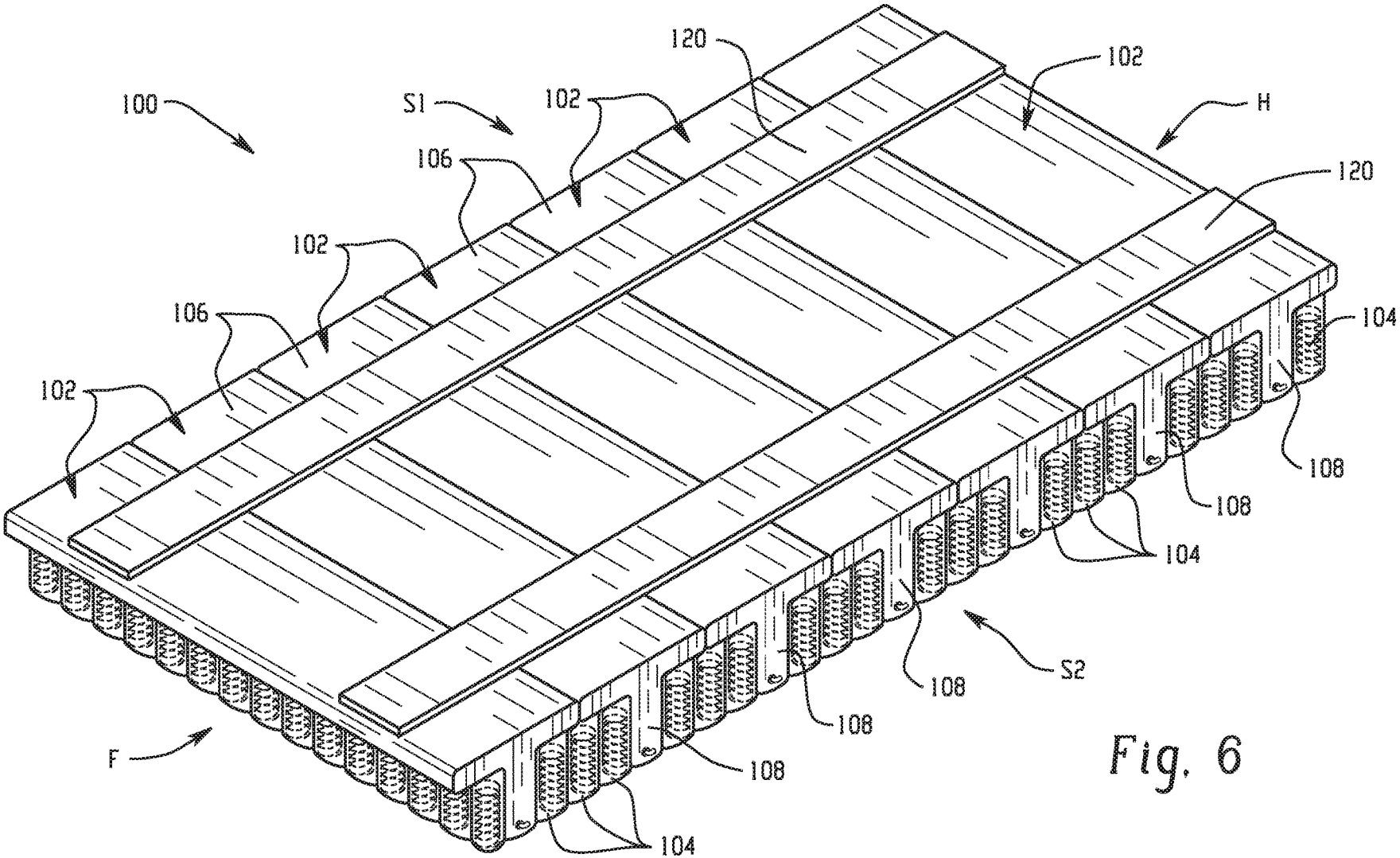
FIG. 6 is a perspective view of a hybrid air-coil spring assembly in accordance another embodiment of the present disclosure.

Turning now to FIG. 6, there is depicted a perspective view of an exemplary hybrid air-coil spring assembly generally designated by reference numeral 100 in accordance with another embodiment of the present disclosure. The hybrid air-coil spring assembly is generally rectangularly shaped and includes a head end (H), a foot end (F) and sides (S1, S2) as previously described.

The illustrated hybrid air-coil spring assembly 100 generally includes a plurality of inflatable T-shaped air chambers 102 and a plurality of pocketed coil springs 104. The T-shaped air chambers are formed of a resilient film-like material, e.g., a flexible plastic or rubber such as polyurethane, polyester, vulcanized rubber or the like. Each of the T-shaped air chambers 102 includes a top air chamber 106 having a horizontally oriented longitudinal axis with respect to a bottom air chamber 108 that has a vertically- and perpendicularly-oriented longitudinal axis with respect to the top air chamber, thereby forming a T-shape to each of the air chambers. or welds of other types.

The top and bottom chambers, e.g., 106, 108, respectively, that define the T-shape are in fluid communication with one another. For ease in manufacturing, the top and bottom panels are independently formed and then fixedly attached to one another with one or more fluid passageways therebetween, but the assembly could also be manufactured as one assembly.

Each of the T-shaped air chambers shown in FIG. 6 are independently in fluid communication with a conduit, which may be fluidly coupled via a common manifold to an inflation control device for selectively regulating air pressure within each the air chamber as will be described in greater detail below. The bottom air chamber 108 is situated between various pairs of pocketed coils 104 such that the top air chamber 106 will rest on top of the pocketed coils 104 when in use. The T-shaped air chambers 102 are arranged such that the top panels form a contiguous planar top surface as shown and can be affixed together or be separate to create a gap between chambers to accommodate airflow. In one embodiment, the T-shaped air chambers 102 extend from one side S1 of the mattress to the other side S2.

Figure 13:
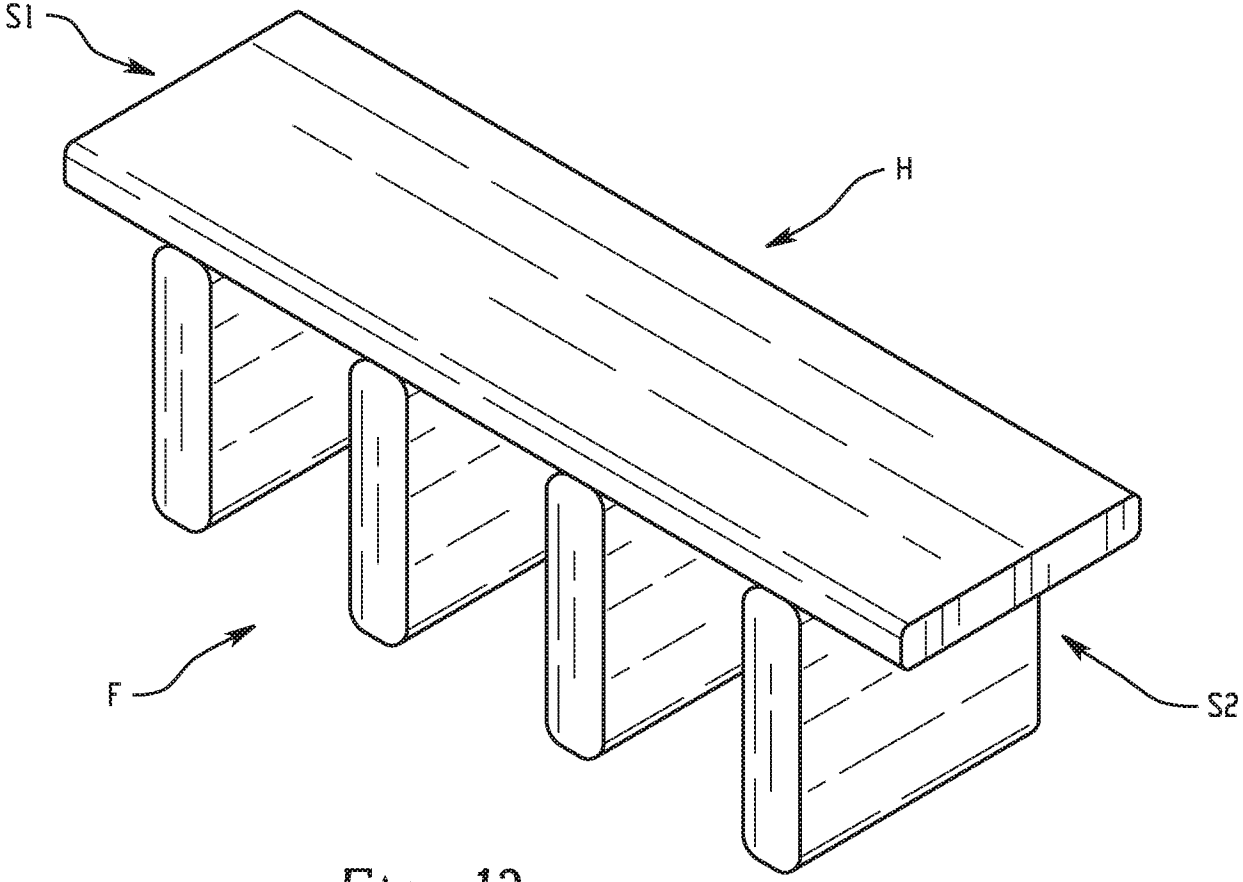
FIG. 13 is a perspective view of the T-shaped air chamber in accordance with another embodiment.

In other embodiments, the T-shaped air chamber extends a fraction from one side of the mattress to the other side. For example, each fraction may be about ½ of the overall length from side to side so as to provide adjustable firmness for mattresses dimensioned to accommodate two occupants. These half like chambers may or may not be attached in an aligned or adjacent manner but operate independently. In this embodiment, there may be more than one T-shaped air chamber with the top air chamber 106 contiguously arranged to collectively define a top surface defined by the air chambers from the head end (H) to the foot end (F) as well as from side (S1) to side (S2). The vertical air chamber 108 can be parallel or perpendicular to the horizontal top air chamber 106, but will consistently be in a parallel relationship to the coil strands. FIG. 13 illustrates an embodiment wherein the top horizontal panel of a t-shaped air chamber extends from side to side (S1) to (S2) and the bottom vertical panel extends perpendicular to the top horizontal and extends between coils from the head end (H) to the foot end (F).

One or more flexible skirt panels 120, two of which are shown, may be welded, sewn, etc. to the top surface of the contiguously arranged top panels 108 so as to improve rigidity to the overall assembly and to maintain orientation if the mattress is articulated with an adjustable bed frame. Likewise, a similar skirt panel (not shown) may be welded sewn, etc. to the exposed side surfaces of the bottom air chamber 108 of the T-shaped panel or adhesively connected to the pocketed coils, or both. This helps ensure vertical or perpendicular alignment of the vertical chambers and maintains the correct or desired distance between the vertical chambers during inflation and deflation and if the mattress is articulated with an adjustable bed frame.

Figure 8:
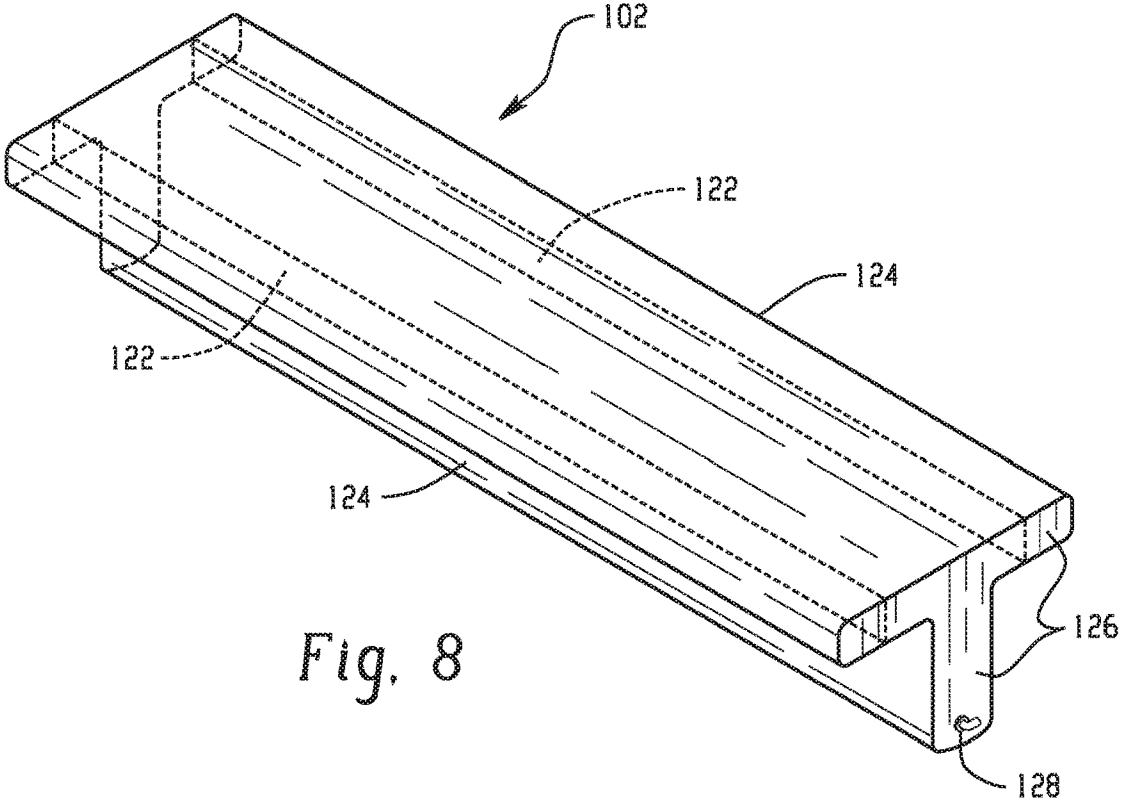
FIG. 8 is a perspective view of the oval shaped air chamber of FIG. 7 in accordance with the present disclosure.
Figure 7:
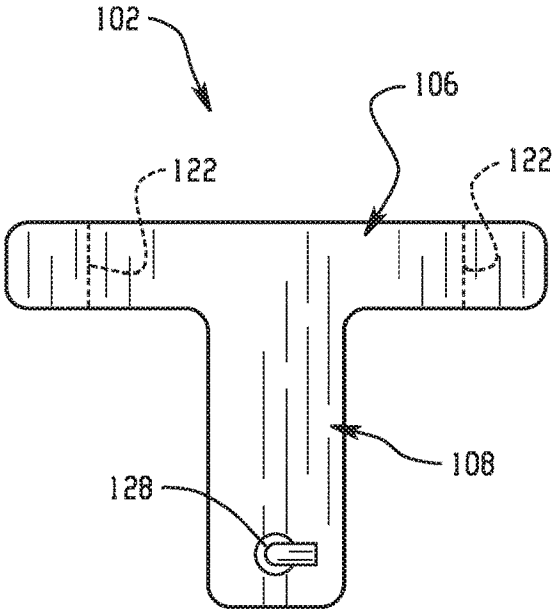
FIG. 7 is an end on view of an T-shaped air chamber for use in a hybrid air-coil spring assembly in accordance with the present disclosure.

As shown more clearly in FIGS. 7-8, each one of the T-shaped air chambers 102 may include partitions or weld creating segments 122 within the chamber in the respective top air chamber 106 as shown and/or the bottom chamber 108 (not shown). The partitions 122 would further include a fluid passageway to further regulate fluid flow as a function of applied load within the T-shaped air chamber 102. As such, the partitions 122 may span the length of the air chamber or a fraction thereof. Each of the top and bottom air chambers 106, 108, respectively, generally includes a body portion 124 and ends 126, wherein the body portions 124 generally have a sleeve shape and is sealed at each opening by the ends 126. A selected one of the ends includes a valve or fitting 128. The location of the valve is not intended to be limited and may include a sensor as previously described. In the embodiment shown, the valve 128 is positioned at a lower portion of the end 126 and is in fluid communication with a conduit (not shown), which may be fluidly coupled via a manifold (not shown) to an air pump (not shown) for selectively and independently regulating air pressure within each of the oval-shaped air chambers as will be described in greater detail below. It should be apparent that the top and bottom chambers may be fabricated separately from each other and subsequently attached to form the T-shape. As noted above, the top- and bottom chambers are in fluid communication with each other so as to minimize conduits needed to provide pressurization. However, in some embodiments, it may be desired to provide the T-shaped with the top and bottom chambers, with each configured with a valve for selective and adjustable pressurization.

In an exemplary embodiment, the hybrid air-coil spring assembly 100 may include nine T-shaped air chambers or more or less depending on the mattress size, wherein the contiguous top panel defines nine zones within the top surface, i.e., nine top air chambers 106 span the area defined by the head end (H), foot end (F) and sides (S1), (S2). Each bottom air chamber 108 of the T-shaped air chambers is arranged between every three strings of pocketed coils, which are arranged in columns. As previously discussed, the top air chambers 106 of each respective T-shaped air chamber 102 will rest on top of the pocketed coils and be contiguously arranged to form a planar top surface. The pressure within each zone defined by the top panel of a T-shaped air chamber can be regulated to provide a desired pressure.

The vertical bottom panel of T-shaped air chambers 102 generally have a height that ranges from 1 to 12 inches; and 2 to 8 inches in other embodiments. The coil springs 104 generally have a height substantially equal to the height of the bottom air chamber 108. Vertical dimension of the bottom chamber is usually about 0.5" to about 1.0" higher than the coils when nominally inflated.

Figure 9:
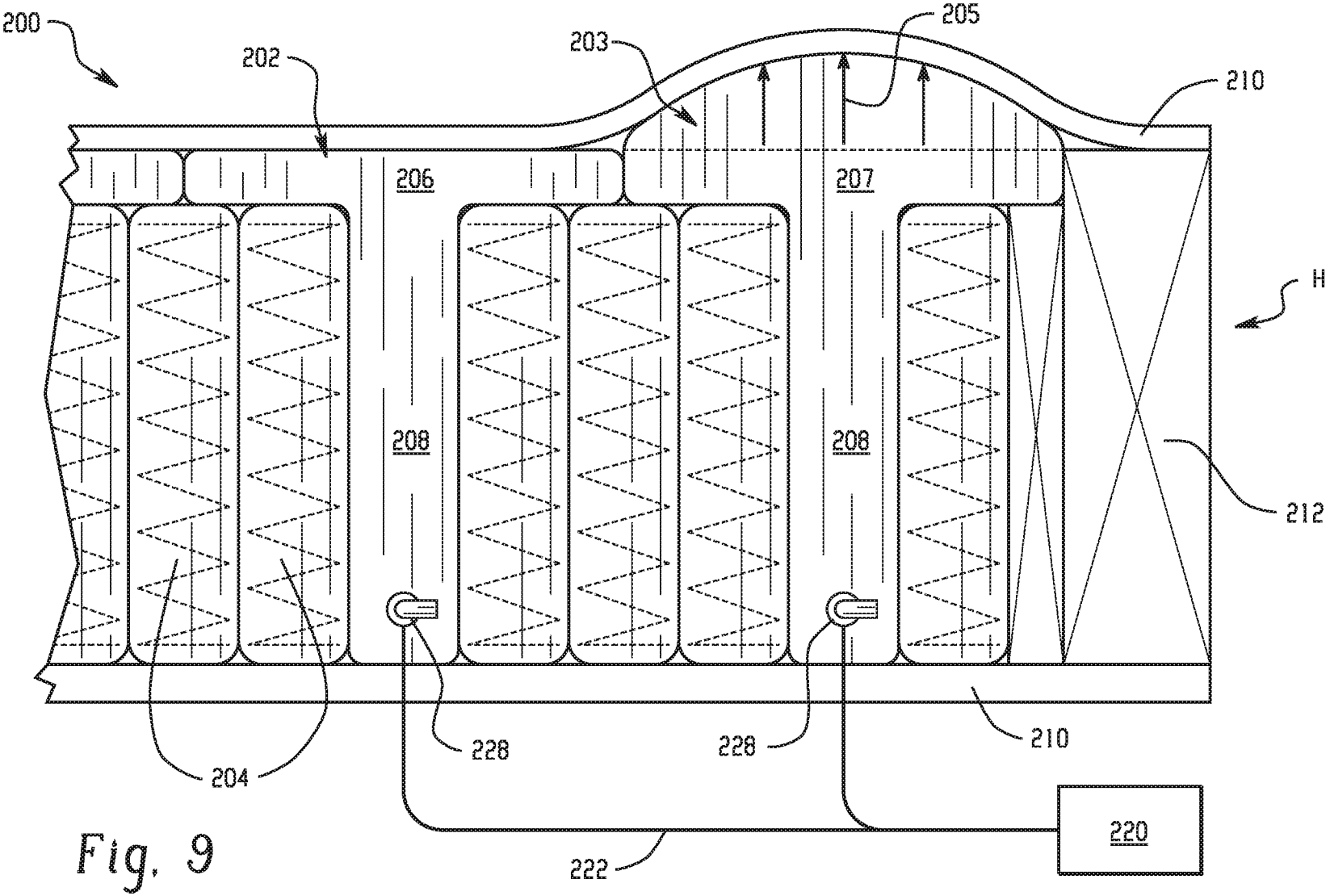
FIG. 9 is a partial side elevational view of a hybrid air-coil spring assembly in accordance another embodiment of the present disclosure.

In another embodiment shown in FIG. 9, a hybrid air-coil spring assembly 200 is configured to provide an integrated pillow or raised platform. The cushioning device may be configured to provide an integrated pillow at the head end, the foot end and/or any desired area of the cushioning device as well. The hybrid air-coil spring assembly 200 generally includes a plurality of inflatable T-shaped air chambers 202 and 203 and a plurality of pocketed coil springs 204. The T-shaped air chambers 202 are as previously described and generally include a top air chamber 206 having a horizontally oriented longitudinal axis with respect to a bottom air chamber 208 that has a vertically- and perpendicularly-oriented longitudinal axis with respect to the top air chamber, thereby forming a T-shape. The T-shaped air chambers 203 are also similarly constructed albeit top air chamber 207 is provided, which is configured to raise the area upon inflation as indicated by arrows 205 where a sleeping person's head would normally rest during use. In one embodiment, the top surface (i.e., the uppermost chamber surface facing the user when in use) or the sleeve defining the top air chamber is formed of a stretchable elastic material that expansively stretches upon inflation. No welds or partitions are formed in the horizontal chamber for the head or foot pillow applications. For the T-shaped air chambers in other areas, the top air chamber may include a partition, button welds or the like to prevent a noticeable amount of expansion above the generally planar surface of the cushioning device, as shown in FIGS. 7, 9, 11 and 12. These methods can also be applied to the vertical chamber of the oval and T-shaped designs as shown in FIG. 2.

For a mattress application, the hybrid air-coil spring assembly 200 may be sandwiched between one or more foam layers 210 as previously described and may further include a side rail assembly 212. Each of the T-shaped air chambers 202 and 203 are in fluid communication with an air pump 220 via a conduit connected to a valve 228 associated with the T-shaped air chamber, which may be selectively inflated or deflated via the air pump 220. As such, the T-shaped air chamber(s) 203 positioned at an area corresponding to a pillow location or the like can be selectively raised and lowered in addition to adjustments in comfort to other areas of the mattress where 202 are located. Likewise, the hybrid air-coil spring assembly 200 may be configured as an innercore and be disposed within a bucket assembly as previously described.

The raised area may function as a pillow in mattress application, i.e., an integrated pillow, or may function as a raised platform as may be desired for zones corresponding to the user's feet location. Moreover, in the case of mattresses configured for two users, each side may be configured to provide a raised area so as to function as a pillow or a raised platform (foot end too). In these embodiments, the T-shaped air chambers 203 would extend from a selected side (S1) or (S2) to about a midline of the mattress. Alternatively, the T-shaped shaped air chambers 203 would extend from side (S1) to (S2), wherein the top air chamber is configured to selectively raise discrete portions there of that correspond to pillow locations. In other embodiments, the T-shaped-shaped air chambers 203 including the top air chamber 207 are configured to raise the planar sleeping surface to a raised surface at about a lumbar region.

In other embodiments, the various inflatable air chambers are foam filled. This could be applicable to the horizontal and vertical chambers of the T-design as well as the chambers of the oval design.

Figure 10:
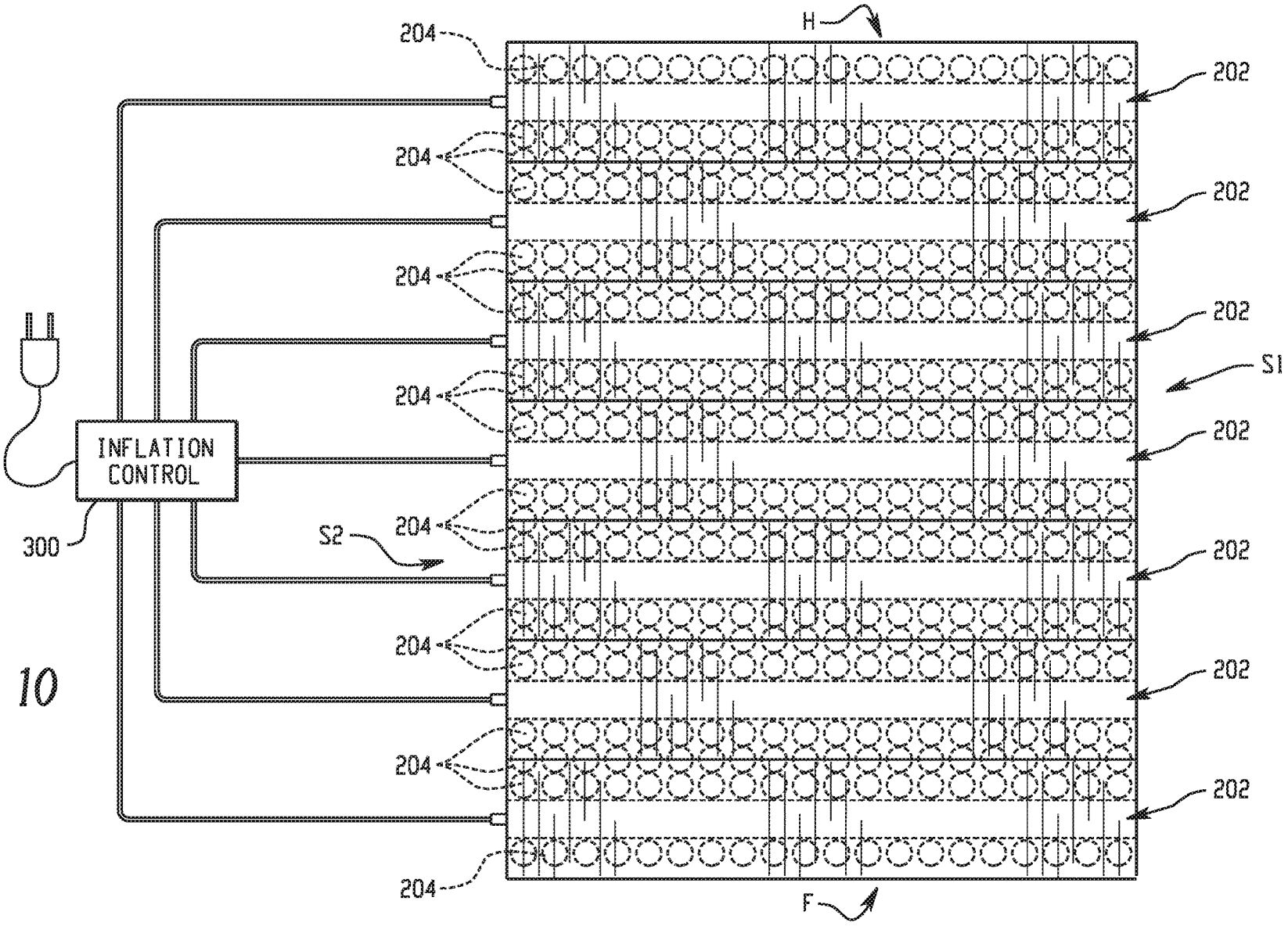
FIG. 10 is a diagrammatic view of a system including a hybrid air-coil spring assembly and an inflation control device in accordance an embodiment of the present disclosure.

Referring now to FIG. 10, the arrangement of the T-shaped air chambers e.g., 202, in accordance with one embodiment of the present invention will now be described. The pocketed coil springs, e.g., 204, are arranged side (S1) to side (S2) in a matrix from of rows and columns as illustrated diagrammatically by the dash lines. Alternatively, the T-shaped air chambers e.g., 202 and the pocketed spring coils, e.g., 204 are arranged head to foot (not shown). In the embodiment illustrated, the T-shaped air chambers are arranged extending side (S1) to side (S2), wherein the bottom air chambers of respective T-shaped channels are between rows of pocketed coils 204 and the top air chambers are contiguously arranged to define a planar surface.

The T-shaped air chambers are connected to an inflation control device 300, either individually or through one or more common manifolds via valves. The inflation control device 300 contains an electric air compressor or air plenum supplied by an air compressor of sufficient size to enable inflation of the T-shaped air chambers to a sufficient pressure to achieve the desired firmness sought. Similarly, the inflation control device 300 can effect selective deflation. The inflation of the T-shaped air chambers may be controlled in a variety of modes. For example, each of the T-shaped air chambers may be inflated to the same pressure simultaneously or to different pressures to provide different portions of the cushioning support with varying degrees of firmness. In addition, the pressure within the T-shaped air chambers or series of chambers may be pulsed between an upper and lower level by means of the inflation control device 124 to create a messaging affect. Alternating chambers are inflating or deflating to create a relaxing alternating pressure message or a repeating wave effect can be created by controlling the rapid inflation and deflation of specific chambers.

The operation of the inflation control device 300, as well as its component parts, may be by means of a programmed microprocessor. It is to be understood that the present disclosure resides in the construction and arrangement of the air chambers within the matrix of the pocketed coil springs of the mattress, and therefore, other means of causing selective inflation or deflation be provided without departing from the present disclosure.

The programmed microprocessor can be in operative communication with one or more sensors such that the inflation control device can selectively inflate and/or deflate one or more of the air chambers in the hybrid air-coil assembly upon detection of a triggering event. Exemplary sensors include pressure sensors, noise sensors, temperature sensors and the like. In this manner, the specific comfort zones defined by the presence of an underlying air chamber can be readily changed to provide the desired level of comfort and contouring, e.g., more firm, less firm. Moreover, the programmed microprocessor can be readily configured to store user settings or timed functions like the wave massage. Likewise, the programmed microprocessor can be configured to provide automatic responses to sleep position so as to maintain personal preferences. The automatic response can be configured to minimize sleep disruptions. For example, motion of the user or repositioning of the user from supine positions to fetal positions can trigger pressure adjustment tor recalibrate the pressure within the different air chambers to a preferred comfort level. In some embodiments, a noise sensor can be employed such that detection of a noise such as snoring or labored breathing results in pressure adjustments to minimize the noise. In the case of the integrated pillow or raised platform discussed above, the detection of snoring could affect inflation of these particular air chambers.

Figure 11:
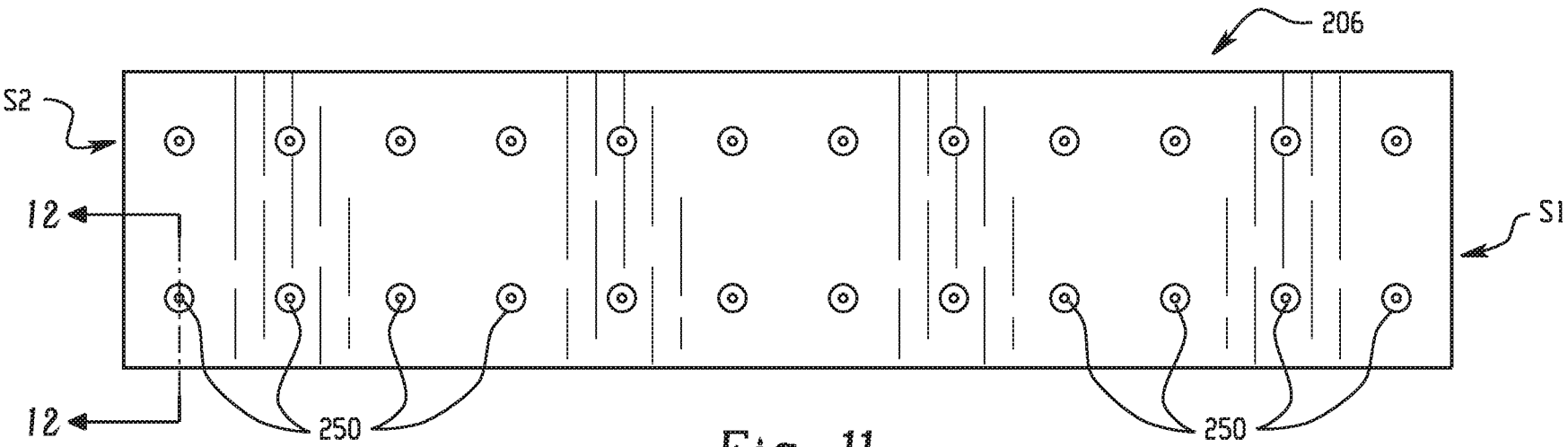
FIG. 11 depicts a top down view of a top air chamber for a T-shaped air chamber in accordance with an embodiment of the present disclosure.
Figure 12:
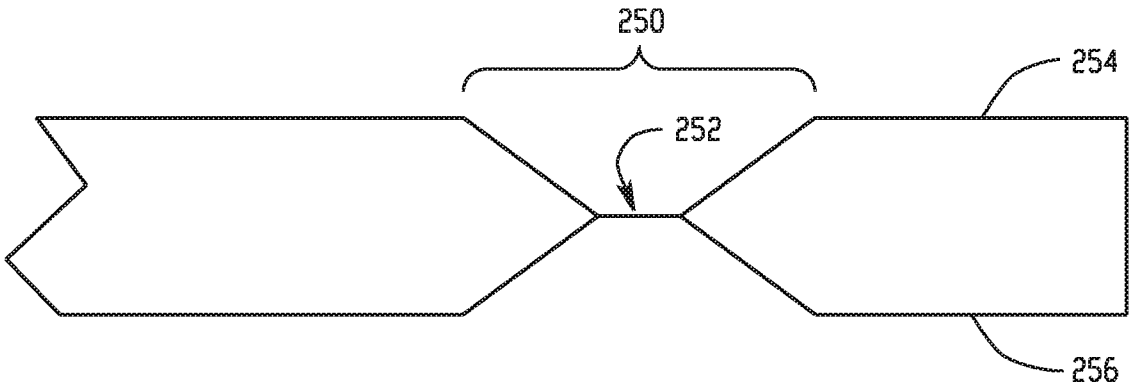
FIG. 12 depicts a partial sectional view taken along lines 12-12 of FIG. 11 of the top air chamber.

Referring now to FIGS. 11 and 12, the top air chamber 206 of the T-shaped air chamber 202 can include a plurality of spaced apart ring or button welds 250. The ring or button welds 250 are formed by attaching selective portions 252 of the top and bottom surfaces 254, 256, respectively, as shown more clearly in FIG. 12. By providing spaced apart ring or button welds as shown, a flat planar top surface profile of the top panel is maintained so as to reduce any exaggerated surface bowing as a function of inflating at higher pressures. It should be apparent that other shapes to the welded surface are also suitable and the ring shape is exemplary.

Optionally, the cushioning devices including the oval shaped air chambers and the T-shaped air chamber may further include a fabric material (not shown) between the respective air chamber and the pocketed coils. In the embodiment the fabric is a low friction material. The fabric material placed between the pocketed coils and chambers provide lubricity, prevent wear and/or noise.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A cushioning support comprising:

a hybrid air-coil assembly sandwiched between first and second layers comprising:

a pocketed spring assembly comprising a plurality of parallel strings of springs joined to each other, each of said strings of springs comprising a row of interconnected pockets, each of said pockets containing at least one spring encased in fabric;

a plurality of pressurized oval shaped air chambers intermediate select portions of adjacent strings of springs; and a low friction material between the pocketed spring assembly and the plurality of pressurized air chambers; and an inflation control device in fluid communication with the plurality of oval shaped air chambers, wherein the inflation control device is configured to inflate or deflate selected ones of the plurality of pressurized air chambers, wherein one or more of the plurality of pressurized air chambers further include internal baffles.

2. The cushioning support of claim 1, wherein the springs and the pressurized air chambers have about equal height dimensions.

3. The cushioning support of claim 1, wherein pressurized air chambers have a height dimension of about 0.5 inch to about 1 inch greater than a height dimension of the springs.

4. The cushioning support of claim 1, wherein the springs are helical springs.

5. The cushioning support of claim 1, wherein the springs are non-helical springs.

6. The cushioning support of claim 1, further comprising a bucket assembly, wherein the hybrid-air coil assembly is disposed within a cavity of the bucket assembly.

7. The cushioning support of claim 1, wherein each one of the plurality of pressurized air chambers is independently connected to a conduit to provide air delivery for inflation and deflation specific to each one of the plurality or pressurized air chambers.

8. The cushioning support of claim 1, wherein the pressurized air chambers are oval shaped.

9. The cushioning support of claim 1, wherein the plurality of pressurized air chambers are T-shaped.

10. The cushioning support of claim 9, wherein each of the T-shaped pressurized air chambers includes a top air chamber having a horizontally oriented longitudinal axis with respect to a bottom air chamber that has a vertically- and perpendicularly-oriented longitudinal axis with respect to the top air chamber.

11. The cushioning support of claim 10, wherein the top and bottom air chambers are in fluid communication with one another.

12. The cushioning support of claim 10, wherein the top chamber includes a plurality of spacer apart button welds.

13. The cushioning support of claim 10, wherein the top chamber includes a plurality of spacer apart button welds.

14. The cushioning support of claim 1, wherein the pressurized air chambers are foam filled.

15. The cushioning support of claim 1, wherein the cushioning support is a mattress.

16. The cushioning support of claim 1, further comprising a plurality of sensors inoperative communication with the inflation control device to provided a triggering event.

17. The cushioning support of claim 1, further comprising a fabric material intermediate a contact surface between the pressurized air chamber and the springs.

18. The cushioning support of claim 1, wherein the inflation control device is configured to alternate between inflation and deflation of the plurality of pressurized air chambers.

* * * * *